US005318111A

United States Patent [19]

Young et al.

[11] Patent Number: 5,318,111

[45] Date of Patent: Jun. 7, 1994

[54] INTEGRAL BAFFLE ASSEMBLY FOR PARALLEL FLOW HEAT EXCHANGER

[75] Inventors: Darryl L. Young, Belleville; Gary J. Blankenberger, Westland, both of Mich.

[73] Assignee: Ford Motor Company, Dearborn, Mich.

[21] Appl. No.: 79,570

[22] Filed: Jun. 22, 1993

[51] Int. Cl.[5] ..... F28F 9/22

[52] U.S. Cl. ..... 165/150; 165/174

[58] Field of Search ..... 165/150, 153, 173, 174, 165/175, 176

[56] References Cited

U.S. PATENT DOCUMENTS

| | | | |
|---|---|---|---|
| 1,991,631 | 2/1935 | Sangster | 165/174 |
| 4,382,468 | 5/1983 | Hastwell | 165/173 |
| 4,960,169 | 10/1990 | Granetzke | 165/173 |
| 5,123,483 | 6/1992 | Tokutake et al. | 165/176 |
| 5,125,454 | 6/1992 | Creamer et al. | 165/173 |

FOREIGN PATENT DOCUMENTS

| | | | |
|---|---|---|---|
| 540404 | 5/1957 | Canada . | |
| 142105 | 2/1902 | Fed. Rep. of Germany | 165/150 |
| 633191 | 6/1986 | Japan . | |
| 153685 | 7/1987 | Japan . | |
| 63-3192 | 1/1988 | Japan . | |
| 127091 | 5/1988 | Japan . | |
| 127094 | 5/1988 | Japan . | |
| 169499 | 7/1988 | Japan . | |
| 336497 | 6/1989 | Japan . | |
| 302592 | 12/1990 | Japan | 165/174 |

*Primary Examiner*—John Rivell
*Assistant Examiner*—L. R. Leo
*Attorney, Agent, or Firm*—Raymond L. Coppiellie; Roger L. May

[57] ABSTRACT

A heat exchanger (10) for an automotive vehicle includes a pair of manifolds (12, 14) each including a header portion (24) and a tank portion (26). The tank portion (26) includes a predetermined number of generally horizontal rib portions (30) formed therein at predetermined positions. The heat exchanger (10) further includes a plurality of tubular elements (16) disposed in spaced, substantially parallel relation and which define flow paths for the coolant between the manifolds (12, 14). At least one of the tubular elements (32) has a length greater than an adjacent tubular element (16) and extends through the header portion into mating engagement with the rib portion (30) of the tank (26) of one of the manifolds to form baffle means (36) for preventing the flow of coolant therepast.

12 Claims, 2 Drawing Sheets

INTEGRAL BAFFLE ASSEMBLY FOR PARALLEL FLOW HEAT EXCHANGER

BACKGROUND OF THE INVENTION

1. Field of the Invention

The present invention relates generally to a parallel flow heat exchanger for an automotive vehicle. More particularly, the present invention relates to a parallel flow condenser having a baffle assembly formed integrally with the tubular elements of the condenser.

2. Disclosure Information

Automotive condensers typically have been constructed with a single length of refrigerant tube assembled in a serpentine configuration with an inlet at one end and an outlet at another end. Fin members are interposed between the parallel portions formed between the bends of the tube. The serpentine type of heat exchanger has been successfully used for many years but has limited efficiency improvement. For example, because the extruded tube is bent into a serpentine shape, it is impossible to make the radius of curvature of the bend smaller than a certain limit so that the pitch of the tubes cannot be made small, limiting the number of fin members that can be placed between the parallel portions of the tube, and thus the heat transfer efficiency of the condenser cannot be maximized.

Because of these deficiencies,, multi-flow or parallel-flow type of heat exchangers have been appearing as replacements for the serpentine type of heat exchangers. In the parallel flow heat exchanger, numerous flat, extruded tube and fin members are alternately placed next to each other with both ends of the tube connected to hollow manifold assemblies. In order to accomplish multiple pass flow within the heat exchanger, one or more baffles are located in the manifold assemblies between its ends.

Various baffle designs have been proposed to provide for the multiple path flow of the heat exchange medium. For example, U.S. Pat. No. 4,960,169 discloses a baffle formed as a collar surrounding a tubular member and extending through the manifold assembly. In this design, the baffle is formed as a separate piece from the tubular member and connected thereto. In such a construction, the connection portion may result in leakage. The cost increase to the condenser is high due to the added complexity of this design.

It would, therefore, be advantageous to provide a parallel flow or multi-flow condenser wherein the baffle assembly is formed integrally with one of the tubular members to overcome the limitations of the prior art.

SUMMARY OF THE INVENTION

The present invention overcomes the disadvantages of the prior art by providing a condenser for liquefying gaseous coolant in an air conditioning system of an automobile after the system has compressed the coolant. The condenser comprises a pair of manifolds each having a longitudinal axis and disposed in spaced, substantially parallel relation at opposite ends of the condenser and which define a coolant inlet and coolant outlet for the condenser. Each of the manifolds comprises a tank portion and a header portion including a plurality of tube receiving slots disposed in substantially parallel relationship. In a preferred embodiment, the tank portion includes a plurality of generally horizontal rib portions formed therein at predetermined positions along the longitudinal axis thereof. The condenser further comprises a plurality of tubular elements disposed in a spaced, substantially parallel relationship and defining flow paths for the coolant between the pair of manifolds. At least one of the tubular elements has a length greater than an adjacent tubular element, with one end thereof being shaped substantially similarly to the inside of the tank portion and which extends through the header portion into engagement with the tank of the manifold to form baffle means for preventing the flow of coolant therepast in a direction generally parallel to the longitudinal access of the manifold. The condenser further includes a plurality of fin members each fin member disposed between adjacent tubular elements.

These and other objects, features and advantages of the present invention will become apparent from the detailed description, drawings and claims which follow.

DETAILED DESCRIPTION OF THE PREFERRED EMBODIMENTS

Figure 1:
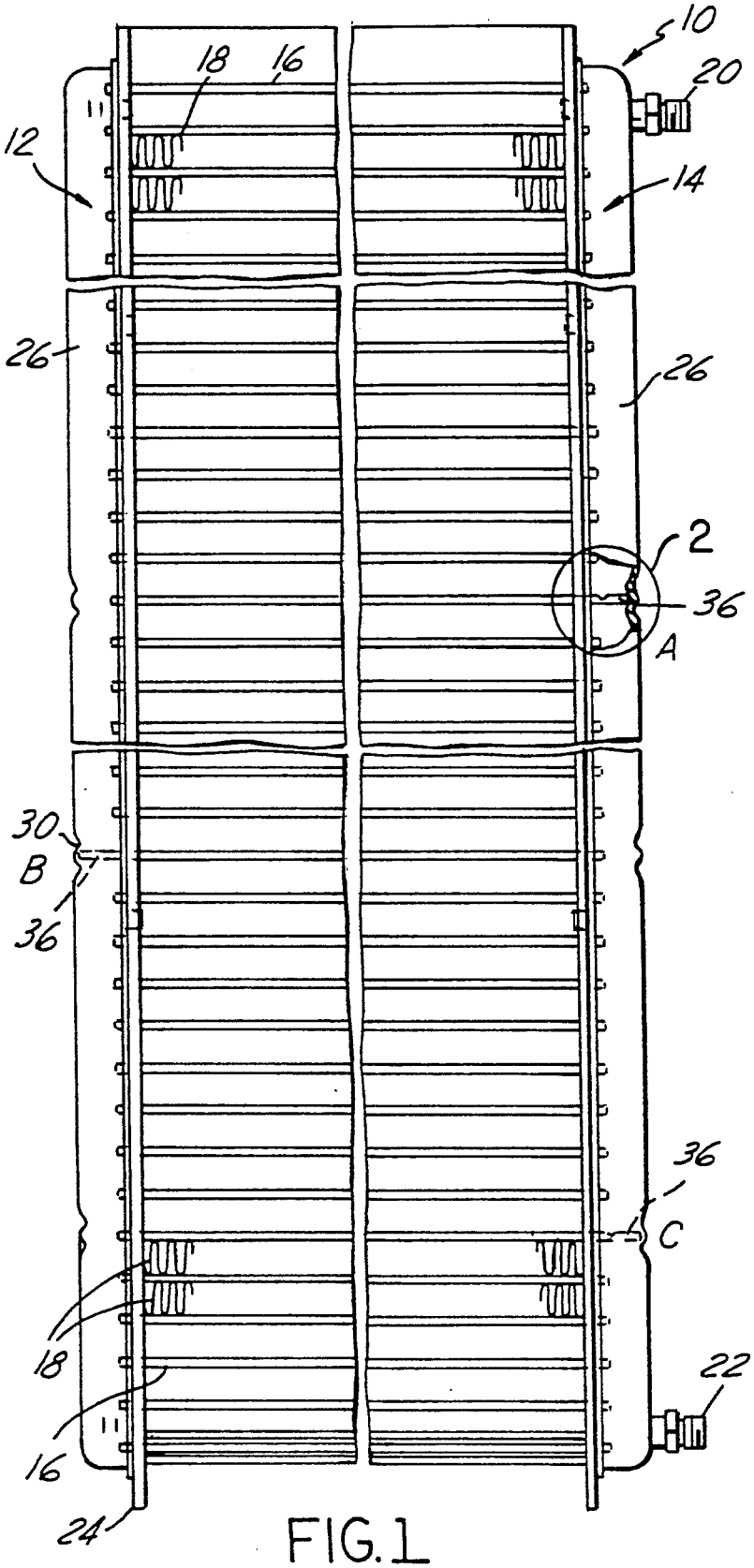
FIG. 1 is a perspective view of a parallel flow condenser structured in accord with the principles of the present invention.
Figure 4:
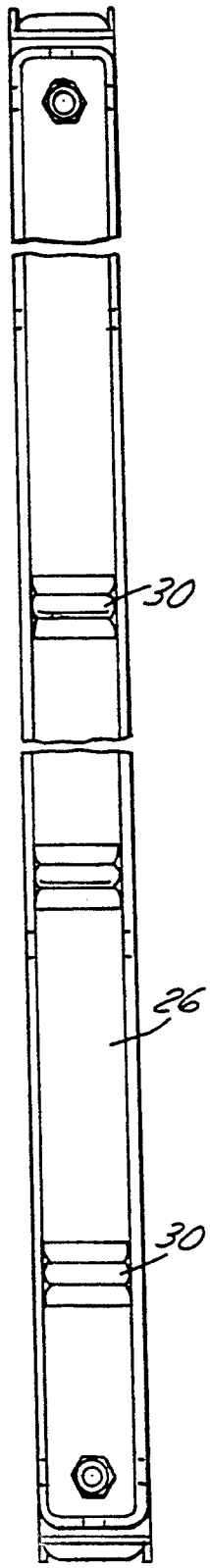
FIG. 4 is a side elevational view of the condenser of FIG. 1.

Referring to the drawings, FIG. 1 shows a parallel flow, or multi-flow heat exchanger 10 for use in an automotive vehicle. Such heat exchanger could be a condenser for liquefying gaseous coolant in an air conditioning system of the vehicle after the system has compressed the coolant in a known manner. It should be apparent to those skilled in the art that the principles of the present invention could be applied to other types of heat exchangers as well. The condenser 10 includes a pair of manifold assemblies 12, 14 each having a longitudinal axis and disposed in spaced, substantially parallel relationship at opposite ends of the condenser. A plurality of substantially parallel tubular elements 16 are disposed in spaced relationship and define flow paths for the coolant between the manifold assemblies 12, 14. As shown in FIG. 1, each of the tubular elements 16 extends into each of the manifold assemblies 12, 14. Interposed between each of the tubular elements 16 are a plurality of fin members 18 provided in a conventional manner. A fluid inlet 20 and fluid outlet 22 are attached to one of the manifold assemblies 14 but alternatively may be placed on opposite sides of the condenser assembly in known manner. In operation, the compressed coolant enters the inlet 20 and is forced through the substantially parallel elements 16 along a plurality of flow paths defined by baffle means formed integrally with a predetermined number of tubular elements as will be described below. At the outlet 22, the compressed coolant has condensed into its liquid state and flows to the next stage in the air conditioning system.

Each of the manifold assemblies 12, 14 includes a header portion 24 having a plurality of tube receiving slots 28 disposed in substantially parallel relationship. Each of the slots includes flanges having dimples 29 and bosses 31 formed around the slots and which follow the internal contour of the tank portion of the manifold. This provides a tube lead-in and a joint fillet pocket as shown by the brazing welds 34 in FIG. 3.

Figure 2:
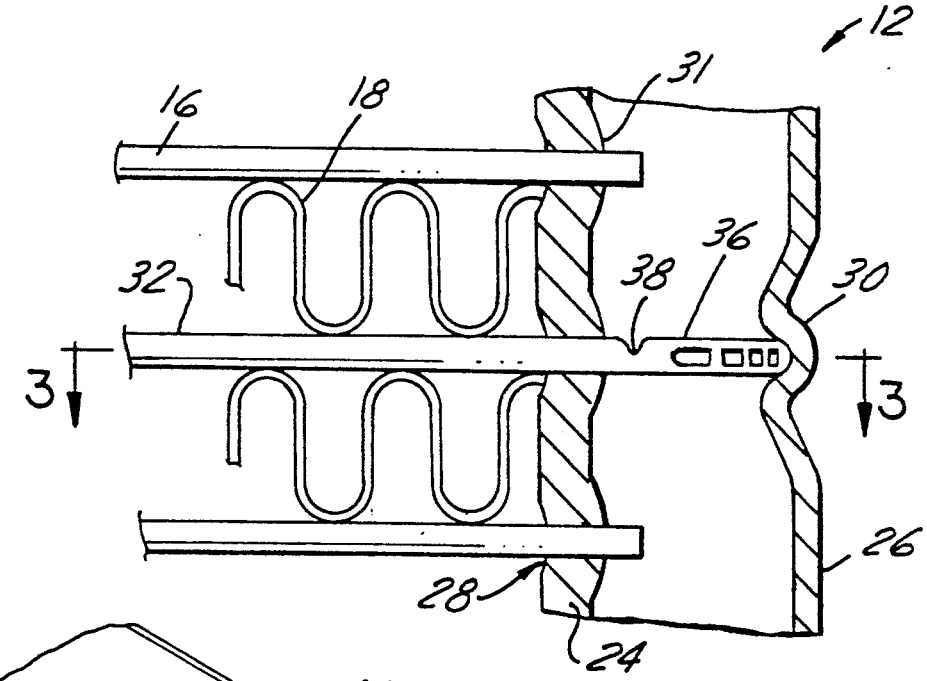
FIG. 2 is an enlarged portion of the circled area of FIG. 1.

The manifold assemblies 12, 14 further include a tank portion 26 each having a plurality of generally horizontal rib portions 30 formed therein at predetermined positions along the longitudinal axis of the tanks 26. The rib portions 30 are formed preferably in a stamping operation or a crimping operation and as shown in FIG. 2, receive one end of an elongated tubular element 32 therein. The elongated tubular element 32 has a length greater than adjacent tubular elements and extends through the header portions 24 into mating engagement with the rib portions 30 of the tank portion 26 of the manifold assemblies. The elongated portion 36 of the tubular element 32 forms baffle means for preventing the flow of coolant therepast in a direction generally parallel to the longitudinal axis of the manifold. As an alternative embodiment, the end of the extended tubular element 32 is shaped substantially similarly to the internal configuration of the tank, such that the tube can be brazed to the tank to form a baffle means without the need for a rib portion.

Figure 3:
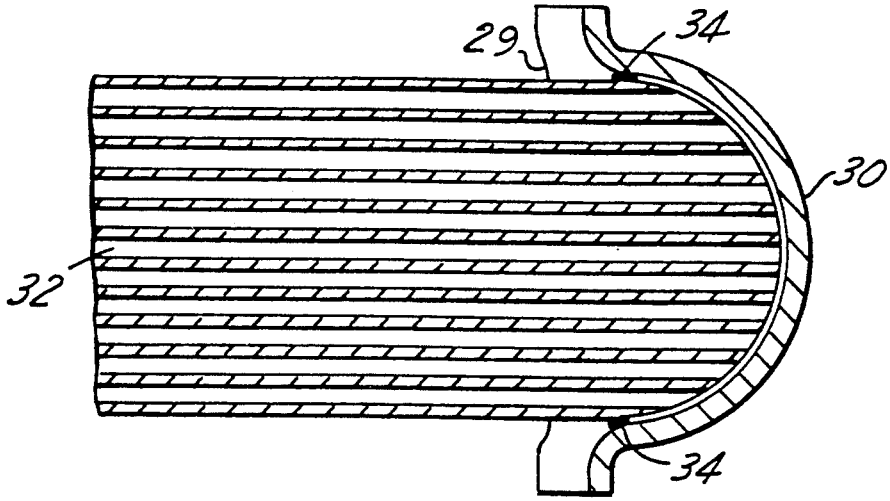
FIG. 3 is a sectional view taken along line 3—3 of FIG. 2.
Figure 5:
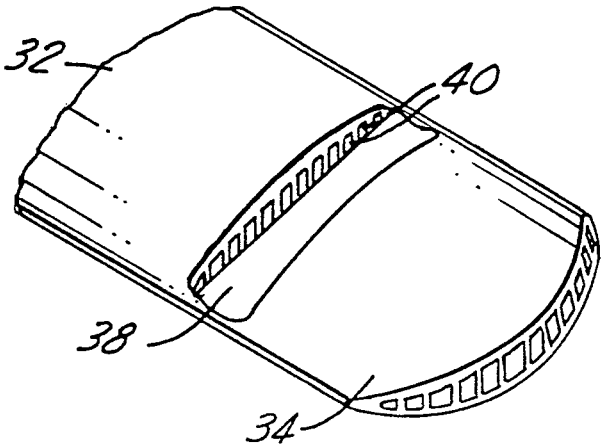
FIG. 5 is an enlarged view of a portion of a tubular element forming the baffle assembly of the present invention.

As shown in FIGS. 2, 3 and 5, in the preferred embodiment, the tubular elements 16, 32 each includes a plurality of smaller hydraulic diameters constructed in conventional manner. Each of the elongated tubular elements 32 includes a notch 38 for receiving the coolant therein so that the tubular element 32 provides an additional flow path for the coolant from one manifold assembly to the opposite manifold assembly. In this manner, the tubular element 32 provides the advantage of operating as an integral baffle assembly by portion 36 as well as a flow path for the coolant.

Referring back to FIG. 1, in the preferred embodiment, three extended length tubular elements are provided shown at A, B, and C to provide four parallel flow paths for the coolant through the condenser 10. It will be apparent to those skilled in the art that any number of flow paths can be provided by increasing or decreasing the number of tubular elements of extended length 32 added to the condenser assembly 10. In this regard, the manifold assembly of the present invention offers increased flexibility in design since any number of flow paths can be constructed utilizing a common tank design having a plurality of rib portions. The rib portions provide no adverse effect on the flow of coolant therepast when not utilized as part of the baffle assembly. Furthermore, by incorporating an inlet/outlet aperture at one end of the tank, a single tank design can be used in manufacturing the condenser when it is appropriate to have fluid inlet on one side of the condenser and fluid outlet on the opposite side.

Various other modifications and variations of the present invention are possible in light of the above teachings. For example, the header portion and tank portion of the manifold assemblies can be formed as separate unitary pieces matingly engageable with one another at predetermined locations or alternatively, can be formed as a single piece in a manufacturing operation. It is therefore to be understood that the following claims, including all equivalents, define the scope of the present invention.

What is claimed is:

1. A condenser for liquefying gaseous coolant in an air conditioning system of an automobile after the system has compressed the coolant, said condenser comprising:

a pair of manifolds each having a longitudinal axis and disposed in spaced, substantially parallel relationship at opposite ends of said condenser and defining a coolant inlet and coolant outlet for said condenser, each of said manifolds including a tank portion and a header portion having a plurality of tube receiving slots disposed in substantially parallel relationship;

a plurality of tubular elements disposed in a spaced, substantially parallel relation and defining flow paths for said coolant between said pair of manifolds, at least one of said tubular elements having one end shaped substantially similarly to the inside of said tank portion and which extends through said header portion into engagement with said tank portion of one of said manifolds to form baffle means for preventing the flow of coolant therepast in a direction generally parallel to the longitudinal axis of said manifold, said at least one tubular element including a notch formed on one side thereof substantially across the width of said tubular element for allowing coolant to enter said tubular element and flow in a direction generally transverse to the longitudinal axis of said manifold to said other manifold; and a plurality of fin members, each fin member disposed between adjacent tubular elements.

2. A condenser according to claim 1, wherein said tank portion of each of said pair of manifolds each includes a plurality of generally horizontal rib portions formed therein at predetermined positions along the longitudinal axis thereof, said rib portions being configured to matingly receive said one end of said tubular elements of greater length therein.

3. A condenser according to claim 2, wherein said at least one tubular element includes a generally arcuate-shaped end which engages one of said plurality of rib portions.

4. A condenser according to claim 2, wherein said condenser includes three tubular elements of the greater length to define four coolant flow paths through said condenser.

5. A condenser according to claim 4, wherein two of said tubular elements of greater length engage said rib portions of one header portion and one tubular element of greater length engages the rib portions of said other header portion.

6. A condenser according to claim 2, wherein said header and tank portions are formed by stamping.

7. A condenser according to claim 6, wherein said rib portions in each header portion are formed by stamping.

8. A condenser according to claim 1, wherein one manifold defines the coolant inlet and outlet.

9. A condenser according to claim 1, wherein each of said header and tank portions of each manifold is a separate unitary piece matingly engageable with each other at predetermined locations.

10. A condenser according to claim 1, wherein each of said manifolds is a unitary member.

11. A condenser according to claim 1, wherein said manifolds, tubular elements and fins members are made of an aluminum alloy.

12. A condenser for liquefying gaseous coolant in an air conditioning system of an automobile after the system has compressed the coolant, said condenser comprising:

a pair of manifolds each having a generally longitudinal axis and disposed in spaced, substantially parallel relation at opposite ends of said condenser and defining a coolant inlet and coolant outlet for said condenser, each of said manifolds comprising:

a header portion including a plurality of tubular element receiving slots disposed in substantially parallel relation; and a tank portion having a predetermined number of generally horizontal rib portions formed therein at predetermined positions along the longitudinal axis thereof;

a plurality of tubular elements disposed in a spaced, substantially parallel relation and defining flow paths for said coolant between said pair of manifolds, at least one of said tubular elements having a length greater than an adjacent tubular element and extending through said header portion into m ting engagement with said rib portion of said tank portion of one of said manifolds to form baffle means for preventing the flow of coolant therepast in a direction generally parallel to the longitudinal axis of said manifold, each of said at least one tubular elements including a notch formed on one side thereof substantially across the width of said tubular element for allowing coolant to enter said tubular element and flow in a direction generally transverse to the longitudinal axis of said manifold to said other manifold; and a plurality of fin members, each fin member disposed between adjacent tubular elements.

* * * * *